US008472847B2

(12) United States Patent
Kayahara

(10) Patent No.: US 8,472,847 B2
(45) Date of Patent: Jun. 25, 2013

(54) DEVELOPING DEVICE AND IMAGE FORMING APPARATUS

(75) Inventor: Yasufumi Kayahara, Tokyo (JP)

(73) Assignee: Canon Finetech Inc., Misato-shi (JP)

( * ) Notice: Subject to any disclaimer, the term of this patent is extended or adjusted under 35 U.S.C. 154(b) by 224 days.

(21) Appl. No.: 12/975,897

(22) Filed: Dec. 22, 2010

(65) Prior Publication Data

US 2011/0176838 A1 Jul. 21, 2011

(30) Foreign Application Priority Data

Dec. 25, 2009 (JP) ..... 2009-293604
Dec. 17, 2010 (JP) ..... 2010-281411

(51) Int. Cl.
*G03G 15/08* (2006.01)

(52) U.S. Cl.
USPC ..... 399/260; 399/254

(58) Field of Classification Search
USPC ..... 399/260, 254, 119, 120, 107
See application file for complete search history.

(56) References Cited

U.S. PATENT DOCUMENTS 6,259,876 B1 * 7/2001 Fukuda et al. ..... 399/254

FOREIGN PATENT DOCUMENTS

JP 2-64586 A 3/1990
JP 8-137235 A 5/1996
JP 2004029596 A * 1/2004

OTHER PUBLICATIONS

Machine translation of Mizoguchi et al. JP 2004-029596.*
Notice of Reason for Rejection dated Dec. 1, 2011, in Japanese Patent Application No. 2010-281411.

* cited by examiner

*Primary Examiner* — David Gray
*Assistant Examiner* — Sevan A Aydin
(74) *Attorney, Agent, or Firm* — Fitzpatrick, Cella, Harper & Scinto

(57) ABSTRACT

Provided is a developing device capable of, with a simple structure, preventing occurrence of image degradation ascribable to a distribution of an amount of fall in a longitudinal direction due to developer replenishment within a developer container. An upper rim portion of a developer regulating wall for adjusting an amount of a developer falling along a developer transport direction of a developer transport path is inclined so as to become low in height in the developer transport direction of the developer transport path. A width of a surface in the developer transport direction of the developer transport path is enlarged along the developer transport direction of the developer transport path. A wall is formed by the developer transported on the developer transport path, and the developer transported in a longitudinal direction is transported in the longitudinal direction while breaking a wall of the developer itself.

5 Claims, 9 Drawing Sheets

DEVELOPING DEVICE AND IMAGE FORMING APPARATUS

BACKGROUND OF THE INVENTION

1. Field of the Invention

The present invention relates to a developing device including a developer regulating wall for regulating an amount of developer falling along a transport direction of a developer transport path, and an image forming apparatus including the same.

2. Description of the Related Art

In recent years, the sizes of an electrophotographic copying machine, an information recording apparatus, and the like are getting smaller and smaller. With the trend toward a downsized developing device and a smaller developer containing capacity so that multiple developing devices can be provided within a limited space around an electrostatic latent image bearing member, it is becoming common practice to separately provide a developer supply portion (hereinafter, referred to as "hopper"). In this case, the supply of the developer from the hopper to the developing device is ideally performed evenly throughout an axial direction of a developer carrying member, but in actuality, in terms of space, the supply of the developer to the developing device is performed by supplying the developer within the hopper through a developer supply port provided to one end portion of a developer transport path.

In an apparatus of the related art, for example, as illustrated in FIG. 11, the developing device includes a developer regulating wall 3 having an upper rim portion 2 for regulating an amount of fall of the developer when the developer transported by a transporting screw falls from the developer transport path 1 along the developer transport direction of the developer transport path 1. The upper rim portion 2 of the developer regulating wall 3 is inclined so as to become lower in height toward the developer transport direction of the developer transport path 1 so that the developer is supplied substantially evenly in the axial direction of the developer carrying member.

Replenishment with the developer is intermittently performed to thereby prevent uneven replenishment with the developer inside the developer container in terms of the longitudinal direction due to an image ratio of an original.

As described above, the developer regulating wall 3 has the upper rim portion 2 for regulating an amount of the developer falling from the developer transport path 1 along the developer transport direction of the developer transport path 1, and the upper rim portion 2 is inclined so as to become lower in height toward the developer transport direction of the developer transport path 1. That is, because the developer regulating wall 2 has such a shape as to become lower in height from a front side toward a rear side when viewed from an operator, the developer supplied from the hopper falls little by little starting from the front side, while the developer remaining without falling is transported toward the rear side by the transporting screw and falls at a transport destination. By repetition of this process, the developer replenished from the hopper is supplied with a specific distribution along the longitudinal direction (hereinafter, the distribution is referred to as "distribution of the amount of fall"), At this time, the developer having a low agglomeratability has a small angle of repose. In contrast, the developer having a high agglomeratability has a large angle of repose. In view of the difference, a technique for determining a width of the upper rim portion 2 of the developer regulating wall 3 and replenishing the developer Substantially even in the longitudinal direction with a Certain width within the developer container irrespective of the agglomeratability of the developer is disclosed (see Japanese Patent Application Laid-Open No H08-137235).

However, when the developer having an excessively agglomeratability is supplied, the developer transported within the developer transport path 1 cannot climb over the developer regulating wall 3 in its high position, and a large amount of developer falls on a downstream side of the developer transport path 1 in the longitudinal direction. As a result, the amount of fall of the developer is larger on the rear side of the developer container. In contrast, when the developer having an excessively high agglomeratability is supplied, the developer transported within the developer transport path 1 climbs over the developer regulating wall 3 in its high position, and a large amount of developer falls on an upstream side of the developer transport path 1 in the longitudinal direction. In any one of the cases, the supply of the developer within the developer container toward the longitudinal direction becomes one-sided, which causes image degradation ascribable to unevenness of the distribution of the amount of fall of the developer.

A change in the agglomeratability (flowability) of the developer is ascribable to a use environment, an unattended environment, a deterioration condition of the developer, and other such causes, but in the following description, the phenomenon is described only with the agglomeratability (flowability) without specifying the use environment or the like. As illustrated in FIG. 8, a larger amount of developer with the agglomeratability of the developer being higher than a central value falls on the front side of the developer container, while a larger amount of developer with the agglomeratability of the developer being lower tends to fall on the rear side. This causes image degradation corresponding to the distribution of the amount of fall within an image. Specifically, a change in an image density is smaller in the position in with a larger amount of developer falls, and a difference in density per sheet on an image become larger in the position in which the amount of fall of the developer is smaller as the number of printing sheets becomes larger. Further, a phenomenon in which an extraneous substance adheres to the developer in advance occurs on a surface of the developer carrying member which is opposed to the position in which a larger amount of developer falls, which tends to cause image degradation.

SUMMARY OF THE INVENTION

The present invention provides a developing device capable of performing balanced supply of a developer within a developer container irrespective of a change of an agglomeratability of the developer, to thereby prevent image degradation ascribable to unevenness in a longitudinal direction of a distribution of an amount of fall of the developer with which the developer container is replenished.

A developing device according to an aspect of the present invention, includes a developer transport path for transporting a developer along an axial direction of a developer carrying member; a developer transporting unit for transporting the developer from one end portion toward another end portion in a developer transport direction of the developer transport path; and a developer regulating wall provided to the developer transport path along the developer transport direction of the developer transport path, the developer regulating wall comprising an upper rim portion for regulating an amount of the developer that falls, wherein: the upper rim portion of the developer regulating wall is inclined so as to become lower in height from an upstream side toward a downstream side in the developer transport direction; and the upper rim portion of the developer regulating wall is formed so that a width of surface thereof in a direction orthogonal to the developer transport direction of the developer transport path is enlarged from the upstream side toward the downstream side in the developer transport direction.

As described above, according to the aspect of the present invention, an upper surface of the upper rim portion is set wider as the upper rim portion of the developer regulating wall becomes lower, and hence the developer regulating wall is formed so that the developer stacked on the upper rim portion of the developer regulating wall has a higher height in a position in which the developer regulating wall is lower. A wall is formed by the developer transported within the developer transport path, and hence the developer is transported in the longitudinal direction while falling so as to climb over the wall of the developer itself. The wall formed by the developer has a lower height as the agglomeratability of the developer becomes lower and has a higher height as the agglomeratability becomes higher. That is, if an apparatus is subjected to a change in the use environment or the like to have the agglomeratability of the developer changed, the wall stacked on the upper surface of the upper rim portion of the developer regulating wall is changed in height. Even if the use environment becomes a high humidity environment and the agglomeratability of the developer becomes higher, the upper rim portion of the developer regulating wall becomes lower in height on the downstream side in the developer transport direction and the width of the surface of the upper rim portion on the downstream side in the developer transport direction becomes larger. Accordingly, a constant height of the wall of the developer formed on the developer regulating wall on the downstream side in the developer transport direction tends to be maintained, a constant amount of the supply of the developer is maintained, and which enables the distribution of the amount of fall of the developer falling into the developer container to be controlled evenly in the longitudinal direction. As a result, the balanced supply of the developer within the developer container to the developer carrying member is performed, and occurrence of image degradation ascribable to the distribution of the amount of fall in the longitudinal direction due to developer replenishment performed within the developer container in the longitudinal direction is prevented.

Further, according to another aspect of the present invention, with such a structure that a supply port for the developer is provided to the developer transport path in proximity to a position in which the upper rim portion of the developer regulating wall has a maximum height, the amount of fall can be controlled to become even by preventing the developer from climbing over the developer regulating wall when an enormous amount of developer is supplied from the supply port in a case where, for example, clogging of the developer within a hopper is eliminated. Accordingly, the balanced supply of the developer within the developer container to the developer carrying member is performed, and the occurrence of image degradation ascribable to the distribution of the amount of fall in the longitudinal direction due to the developer replenishment performed within the developer container in the longitudinal direction is prevented.

Further, according to further another aspect of the present invention, with such a structure that a helical-shaped screw is provided as the developer transporting unit provided with the developer transport path, transport of the developer within a transport route in the longitudinal direction is stabilized, and the amount of fall toward the developer carrying member can be controlled to become even. Accordingly, the balanced supply of the developer within the developer container to the developer carrying member is performed, and the occurrence of image degradation ascribable to the distribution of the amount of fall in the longitudinal direction due to the developer replenishment performed within the developer container in the longitudinal direction is prevented.

Further, according to still another aspect of the present invention, with such a structure that the developer is subjected to replenishment from a developer supply portion intermittently, transport of the developer within the transport route in the longitudinal direction is stabilized, and the amount of fall toward the developer carrying member can be controlled to become even. Accordingly, the balanced supply of the developer within the developer container to the developer carrying member is performed, and the occurrence of image degradation ascribable to the distribution of the amount of fall in the longitudinal direction due to the developer replenishment performed within the developer container in the longitudinal direction is prevented.

As described above, according to one aspect of the present invention, the upper rim portion of the developer regulating wall for regulating the amount of the developer falling from the developer transport path along the developer transport direction of the developer transport path is inclined so as to become lower in height toward the developer transport direction of the developer transport path, and the width of the surface of the upper rim portion in the direction orthogonal to the developer transport direction of the developer transport path is enlarged along the developer transport direction of the developer transport path to thereby form a wall by the developer transported in the developer transport path. Thus, the fall of the transported developer toward a direction orthogonal to the longitudinal direction is regulated by the wall of the developer itself. Hence, even if the agglomeratability of the developer changes due to environmental conditions, the wall of the developer stacked on the upper surface of the developer regulating wall changes in height, and the supply of the developer in the longitudinal direction and the fall thereof toward the direction orthogonal to the longitudinal direction are performed substantially evenly irrespective of the agglomeratability of the developer. Accordingly, the occurrence of image degradation ascribable to the distribution of the amount of fall in the longitudinal direction due to the developer replenishment performed within the developer container in the longitudinal direction is prevented, and reliability of the developing device and the image forming apparatus can be enhanced with a simple structure.

Further features of the present invention will become apparent from the following description of exemplary embodiments with reference to the attached drawings.

DESCRIPTION OF THE EMBODIMENT

Hereinafter, an embodiment obtained by applying the present invention to a copying machine functioning as an image forming apparatus is described in detail with reference to the accompanying drawings.

Figure 1:
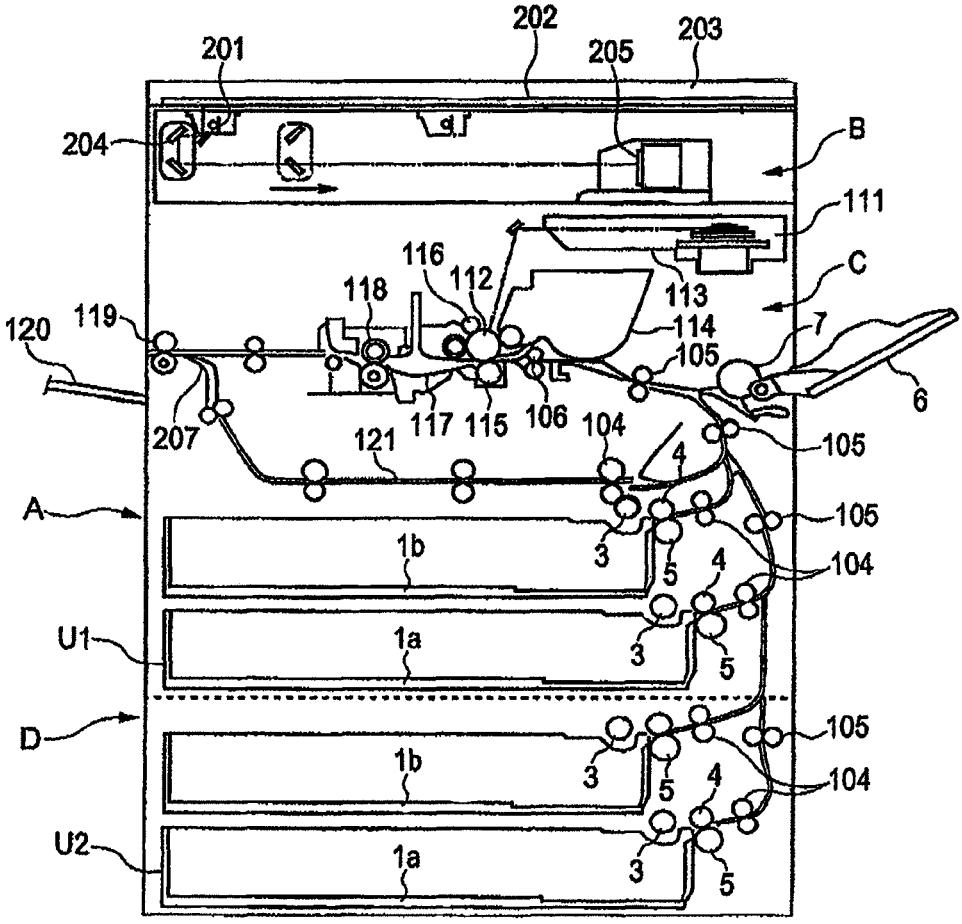
FIG. 1 is an explanatory vertical sectional view illustrating an outline of an overall structure of a copying machine as an example of an image forming apparatus to which the present invention is applied.
Figure 3:
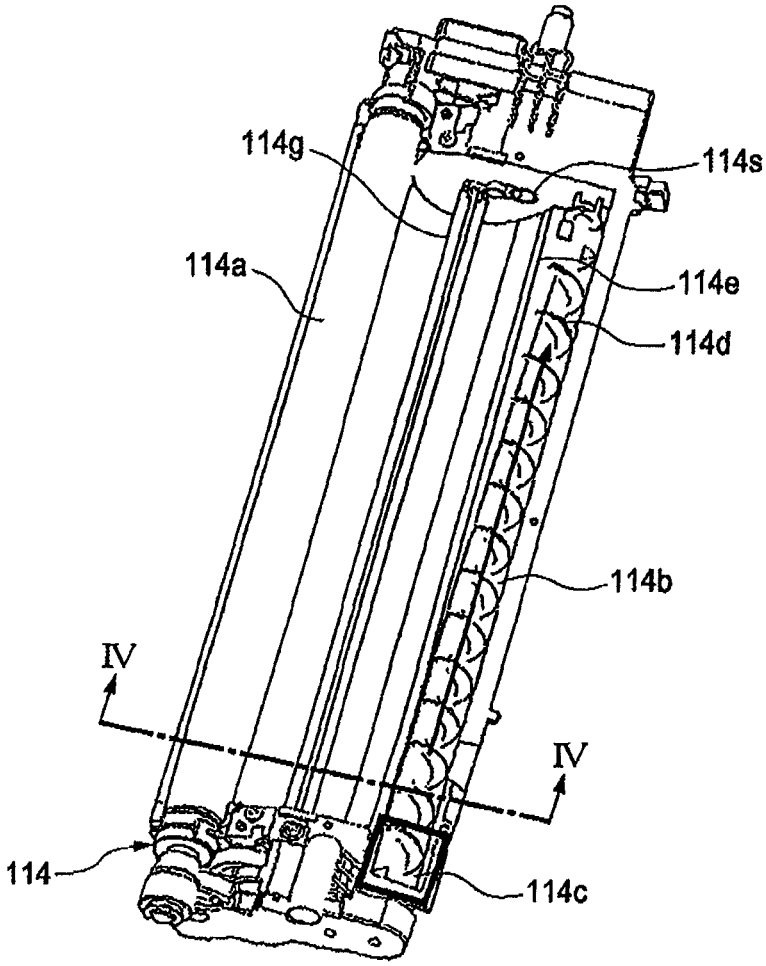
FIG. 3 is an explanatory exploded perspective view illustrating an internal structure of a developing device used in the copying machine illustrated in FIG. 1.
Figure 4:
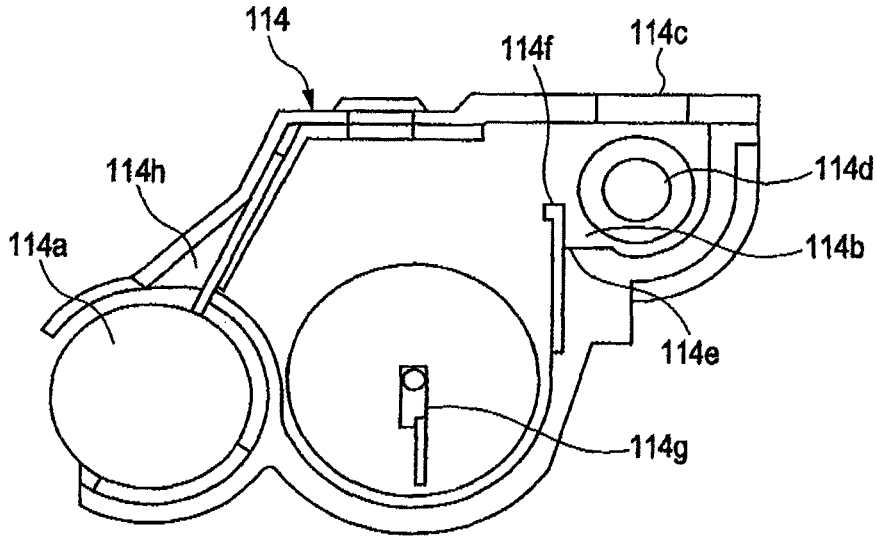
FIG. 4 is an enlarged lateral-sectional view taken along the line IV-IV of FIG. 3.
Figure 5:
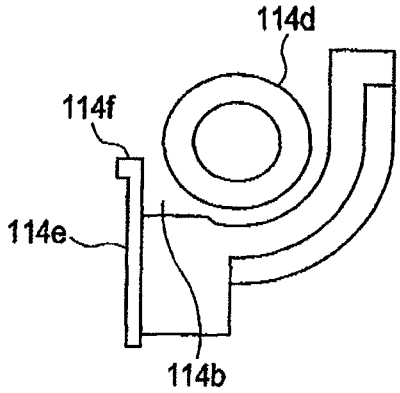
FIG. 5 is an enlarged lateral-sectional view enlargingly illustrating a developer transport path included in the developing device illustrated in FIG. 3.

First, as illustrated in FIG. 1, an overall structure of the copying machine to which the present invention is applied includes a scanner section B, an image forming section C, and a sheet deck D which are provided as sections of an image forming apparatus main body A. The scanner section B functioning as a image reading unit for reading image information of a book original is located in an upper part of the above-mentioned image forming apparatus main body A, and the image forming section C functioning as a image forming unit is provided in a lower part of the image forming apparatus main body A. Further, the sheet deck D is assembled below the image forming section C. As illustrated in FIG. 3, a developing device 114 includes a developer container for containing a developer within which a developer transport path 114*b* is provided so as to extend along the axial direction of a developer carrying member (developing sleeve) 114*a*. The developing device 114 also includes: a supply port 114*c* for a developer provided to one end portion of the developer transport path 114*b* in a developer transport direction; and a developer transporting unit (hereinafter, referred to as "transporting screw") 114*d* for transporting the developer supplied through the supply port 114*c* within the developer container in a longitudinal direction, in other words, from one end portion of the developer transport direction of the developer transport path 114*b* toward the other end portion. Further, the hopper is located above the supply port 114*c* through which the developer is supplied to the developer container, and the developer container is replenished with the developer according to a signal sent from a remaining developer amount sensor 114*s* in order to make a developer amount within the developer container constant. Here, the developer supplied from the above-mentioned hopper to the supply port 114*c* is transported in the longitudinal direction by the transporting screw 114*d* functioning as a transporting unit, and the developer transported in the longitudinal direction successively climbs over the developer regulating wall 114*e* to be supplied to an agitating chamber. Then, new and old developers are agitated by an agitating member 114*g* and carried by the developer carrying member 114*a*. While being transported by rotation of the developer carrying member 114*a*, the developer is applied thereto as a thin-layer coat by a developer layer regulating member 114*h*, and is subjected to development on the latent image bearing member by a predetermined developing method. The transporting screw 114*d* functioning as the above-mentioned developer transporting unit is controlled to supply the developer, which has been supplied from the hopper, substantially evenly inside the developer container in terms of the longitudinal direction.

The above-mentioned scanner section B includes the respective components such as a scanning system light source 201, a platen glass plate 202, an original pressure plate 203 that can open/close with respect to the image forming apparatus main body A, a mirror 204, a light-receiving element (photoelectric conversion element) 205, and an image processing portion. When a reading start key is depressed after a book original or a sheet-like original such as a book or a recording sheet is placed on the platen glass plate 202 with its original surface facing down and is set at rest with its back surface being depressed by the original pressure plate 203, the scanning system light source 201 reads the image information on the original surface by scanning below the platen glass plate 202 in a direction indicated by the arrow. The image information on the original read by the scanning system light source 201 is processed by the image processing, portion, converted into an electrical signal, and transmitted to a laser scanner 111 of the image forming section C. Here, the image forming apparatus main body A functions as a copying machine by inputting a processing signal from the image processing portion to the laser scanner 111 of the image forming section C, and functions as a printer by receiving an input of a signal Output from an external apparatus (computer). Further, the image forming apparatus main body A functions as a facsimile apparatus by receiving a signal from another facsimile apparatus and transmitting a signal from the image processing portion to another facsimile apparatus.

Meanwhile, a sheet feeding tray 1 constituting a sheet feeding unit is attached below the above-mentioned image forming section C. That is, the sheet feeding tray 1 constitutes one sheet feeding unit functioning as the sheet feeding unit by combining two sheet feeding trays of a lower stage sheet feeding tray la and an upper stage sheet feeding tray 1*b*, and in this embodiment, total four sheet feeding trays including two sheet feeding units U1 and U2 can be attached. The one sheet feeding unit U1 located at an upper level is detachably attached to the image forming apparatus main body A, and the sheet feeding unit U2 at lower level is detachably attached to the sheet deck D.

Sheet-like recording medium such as cut paper received inside the lower stage sheet feeding tray 1*a* and the upper stage sheet feeding tray 1*b* as described above are sent out by pickup rollers 3 also included in the sheet feeding unit, separated/fed sheet by sheet by cooperative action of a feed roller 4 and a retard roller 5, then conveyed to registration rollers 106 by conveying rollers 104 and 105, and fed to the image forming section C by the registration rollers. 106 in synchronization with an image formation operation described later. Further, a manual feed tray 6 is located on a side surface of the image forming apparatus main body A as the sheet feeding unit provided separately from the above-mentioned sheet feeding tray 1, and a sheet S on the manual feed tray 6 are sent out to the registration rollers 106 by a manual feed roller 7.

Further, the image forming section C includes an electrophotographic photosensitive drum 112, an image writing optical system 113, a charging roller 116, a developing device 114, and a transfer charger 115. A laser beam corresponding to the image information emitted from the laser scanner 111 is scanned by the image writing optical system 113 on a surface of the photosensitive drum 112 uniformly charged by the charging roller 116 to form an electrostatic latent image, and the electrostatic latent image is developed by the developing device 114, to thereby form a toner image. The toner image formed on the photosensitive drum 112 is transferred onto a first surface of the sheet-like recording medium (sheet) sent out from the above-mentioned registration rollers 106 in synchronization with rotation of the photosensitive drum 112, at a transfer portion in which the transfer charger 115 is located.

Here, FIG. 1 illustrates a conveying portion 117 for conveying the sheet-like recording medium on which the toner image is formed as described above, and also illustrate a fixing device 118 and delivery rollers 119. The above-mentioned conveying portion 117 is structured to be able to convey the sheet-like recording medium (recording sheet) on which the toner image is formed in such a manner that the sheet-like recording medium on which the toner image is formed is conveyed to the fixing device 118 by the above-mentioned conveying portion 117. The sheet-like recording medium has the toner image fixed to its front surface by being heated and pressurized at the fixing device 118, then delivered to a delivery tray 120 by conveying action of the delivery rollers 119, and stacked thereon As described above, the copying machine functioning as the image forming apparatus illustrated in FIG. 1 includes the developing device 114 according to the embodiment of the present invention in the image forming section C.

Further, in a case where images are recorded on both surfaces Of the sheet-like recording medium (recording sheet), when a trailing end of the sheet-like recording medium delivered from the above-mentioned fixing device 118 passes a branch point 207 immediately before the delivery rollers 119, the delivery rollers 119 is driven to rotate in a reverse, direction. By this operation; the above-mentioned sheet-like recording medium is temporarily placed on a two-side tray 121, and then conveyed by the conveying rollers 104 and 105 to reach the registration rollers 106. An image is formed on a back surface (second surface) of the reversed sheet-like recording medium in the same manner as described above, and then delivered to/stacked on the delivery tray 120.

Figure 2:
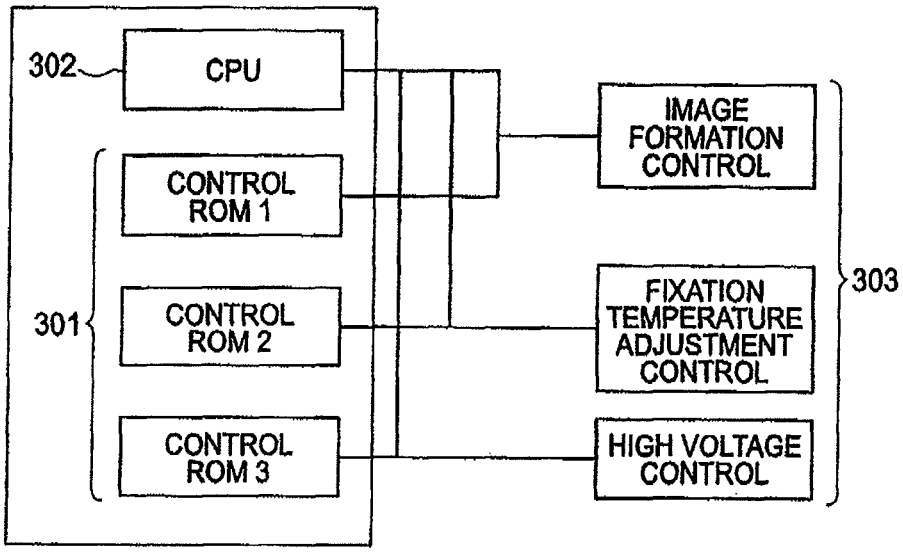
FIG. 2 is a block diagram illustrating a structural example of an image forming control portion used in the copying machine illustrated in FIG. 1.

At this time, the respective components performing the above-mentioned image formation operation are controlled by such an image forming control portion as illustrated in, for example, FIG. 2. The image forming control portion according to this embodiment schematically includes a ROM 301 that stores various control programs necessary for the image formation operation and a central processing unit (CPU) 302 for administrating an overall operation of the image forming apparatus by including a nonvolatile memory and a volatile memory that store various kinds of data related to the image formation operation and executing the various control programs. The CPU 302 is connected via a predetermined interface (I/O) and a bus to various actuators 303 involved in the image formation operation which include, for example, image formation control fixation temperature adjustment control, and high voltage control.

Here, as illustrated in FIG. 3, a developing Sleeve 114*a* functioning as a developer carrying member is located in a leading end part of a developer container provided to the developing device 114 so as to be driven to rotate, and a developer transport path 114*b* for transporting a developer along an axial direction of the above-mentioned developing sleeve 114*a* is provided in a trailing end part of the developer container so as to form a substantially circular arc shape when viewed cross-sectionally. A supply port 114*c* connected to a hopper thereabove is provided in one end part (front side part when viewed from an operator) of the developer transport path 114*b* in such a manner that the developer transport path 114*b* As replenished with the developer through the supply port 114*c*.

Figure 8:
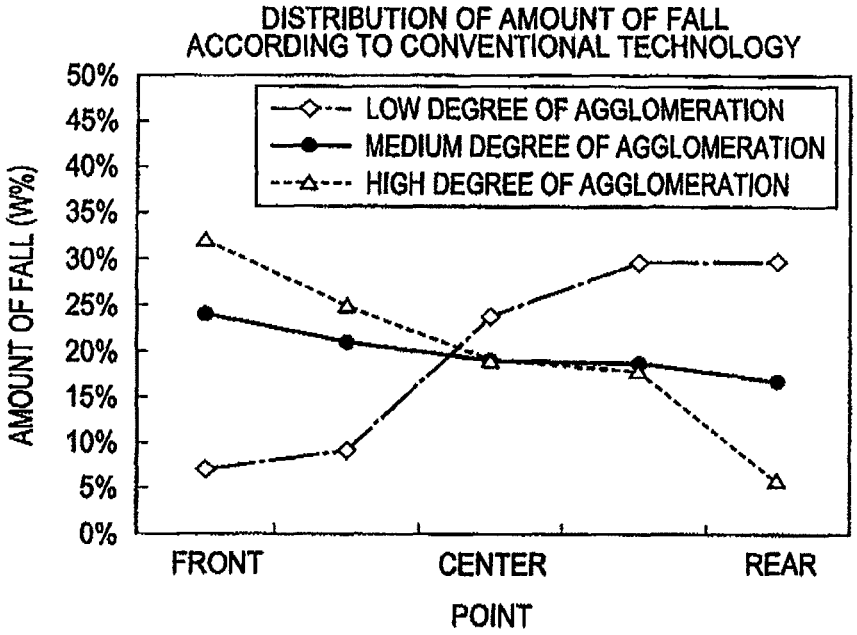
FIG. 8 is a chart illustrating a distribution of an amount of fall in a longitudinal direction exhibited by a conventional apparatus.

Here, an agglomeratability of the developer is described. In a case where the agglomeratability of the developer is low, the developer is regulated by the developer regulating wall so as to exhibit a substantially even distribution in a longitudinal direction under a state in which the agglomeratability (flowability) of the developer is a central value. When the developer amount was measured in five areas into which an agitating area of the developer regulating wall is divided along the longitudinal direction, it was found that the distribution of the amount of fall of the developer changes according to the agglomeratability of the, developer, for example, illustrated in FIG. 8. The phenomenon is described hereinbelow. Measurement conditions for a distribution of an amount of fall described above are as follows. That is, the developer replenishment is intermittently performed as a replenishment method from the hopper having a developer supplying ability of 1.0 g/sec, and a transporting screw having a screw outer diameter of 13 mm, a shaft outer diameter of 8 mm, and a screw pitch of 20 mm is used as a transporting screw 6 and is caused to rotate at 24 rpm.

That is, in a case where the developer container is replenished with the developer from the hopper through a supply port provided to an end portion of the developer container in the longitudinal direction and where the developer is supplied toward the developer carrying member (developing sleeve) substantially evenly in the longitudinal direction while being transported in the longitudinal direction within the developer container, a transporting ability in the above-mentioned longitudinal direction differs if the agglomeratability of the developer differs. If the agglomeratability is high, the developer within the developer container is not satisfactorily transported up to a rear side within the developer container, and the developer climbs over the developer regulating wall on the front side within the developer container to be supplied toward the sleeve. On the other hand, if the agglomeratability of the developer is too low (if the flowability is too good), the developer within the developer container is transported toward the rear side to excess, and the developer amount supplied toward the developer carrying member (developing sleeve) decreases on the front side within the developer container.

Note that, this time, the agglomeratability of the developer is found by using a powder tester manufactured by Hosokawa Micron Corporation in the following manner. First, three circular sieves having a diameter of 100 mm are overlaid to be set as a 60-mesh, 100-mesh, and 200-mesh according to Japanese Industrial Standards (JIS) in the stated order from above. Then, a bundle of sieves, which is set so that an interval between the sieves is 20 mm, is placed on a vibration generator and vibrated vertically at a frequency of 50 Hz with an amplitude of 0.7 mm. Under the settings, 5.0 g of subject developer is placed on the bundle of sieves and subjected to the vibration for 15 seconds. The weight of the developer remaining on the top sieve is set as M1, the weight of the developer remaining on the middle sieve is set as M2, and the weight of the developer remaining on the bottom sieve is set as M3. By substituting the respective values of M1, M2, and M3 into the following arithmetic expression, the agglomeratability is expressed as a percentage.

$$\text{Agglomeratability (\%)} = M1\times 20 + M2\times 12 + M3\times 4 \qquad \text{Expression (1)}$$

In this embodiment, according to the above measuring method, the agglomeratability of the developer having a high agglomeratability is 62%, the agglomeratability of the developer having a middle agglomeratability is 36%, and the agglomeratability of the developer having a low agglomeratability is 14%.

Located inside the developer transport path 114*b* of the developing device according to this embodiment is the transporting screw 114*d* functioning as a developer transporting unit for transporting the developer from one end part (front side part when viewed from the operator) in a developer transport direction of the developer transport path 114*b* toward the other end part (rear side part when viewed from the operator). The transporting screw 114*d* has a function of transporting the developer within the developer transport path 114*b*, which is located so as to cover the transporting screw 114*d* from a bottom side thereof to a backward part thereof, along the axial direction of the above-mentioned developing sleeve 114*a* in such a manner that the developer being transported midway through the developer transport path 114*b* falls from a rim portion of the developer transport path 114*b* on a leading end side toward the above-Mentioned developing sleeve 114*a*.

Meanwhile, the developer regulating wall 114*e* is provided so as to rise upward in the rim portion of the leading end side of the developer transport path 114*b* from which the developer falls. An upper rim portion of the developer regulating wall 114*e* has an upper rim portion 114*f* for regulating an amount of developer falling along the developer transport direction of the developer transport path 114*b*. The upper rim portion 114*f* of the developer regulating wall 114*e* is inclined so as to become lower in height toward the above-mentioned developer transport direction. In addition, a specific inclination angle of the developer regulating wall 114*e* is determined in a manner similar to the apparatus of the related art.

Figure 13:
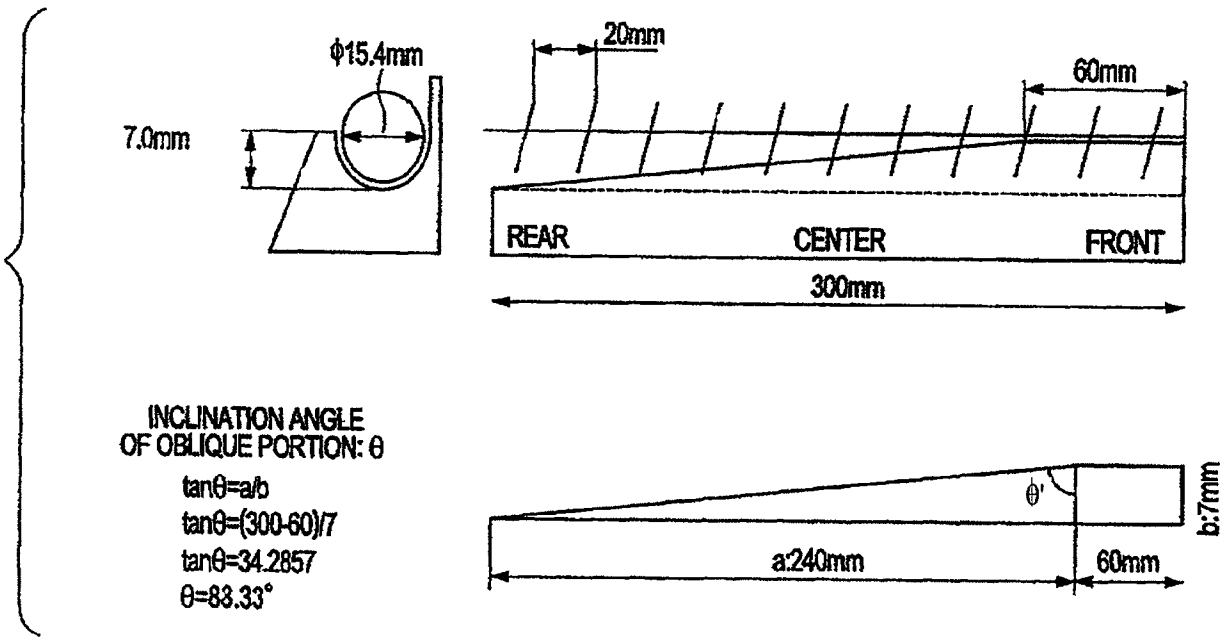
FIG. 13 is a schematic diagram illustrating shapes of the transporting screw and the developer regulating wall, in which (a) is a schematic side view illustrating an end surface shape of a front side, (b) is a schematic side view illustrating a positional relationship between the transporting screw and the developer regulating wall, and (c) is a schematic side view illustrating a shape of the developer regulating wall.

An inclined shape of the developer regulating wall is described in detail with reference to FIG. 13. FIG. 13 is a schematic diagram illustrating shapes of the transporting screw, the developer regulating wall, and the upper rim portion of the developer regulating wall. The regulating wall is designed in consideration of a use environment occasion when the flowability is good for the developer with which a developing device is replenished under a normal environment (N/N environment) or a low temperature/low humidity environment (L/L environment) (as described later, the flowability of the developer is lowered in a high humidity environment, which may cause a problem with a shape of the regulating wall kept the same as under the environment with a good flowability). Under the environment with a good flowability, the regulating wall is formed to be inclined at a predetermined angle θ' so that the developer falls (is transported toward the sleeve) evenly in the longitudinal direction of the developer container by the transporting screw 114*d*. In this embodiment, the developer regulating wall is inclined by approximately two degrees from a position advancing by 60 mm from the front side, to which the developer is supplied, toward the rear side. With this shape, under the environment with a good flowability, the developer is transported evenly along the longitudinal direction of the developing sleeve 114*a*.

Figure 6:
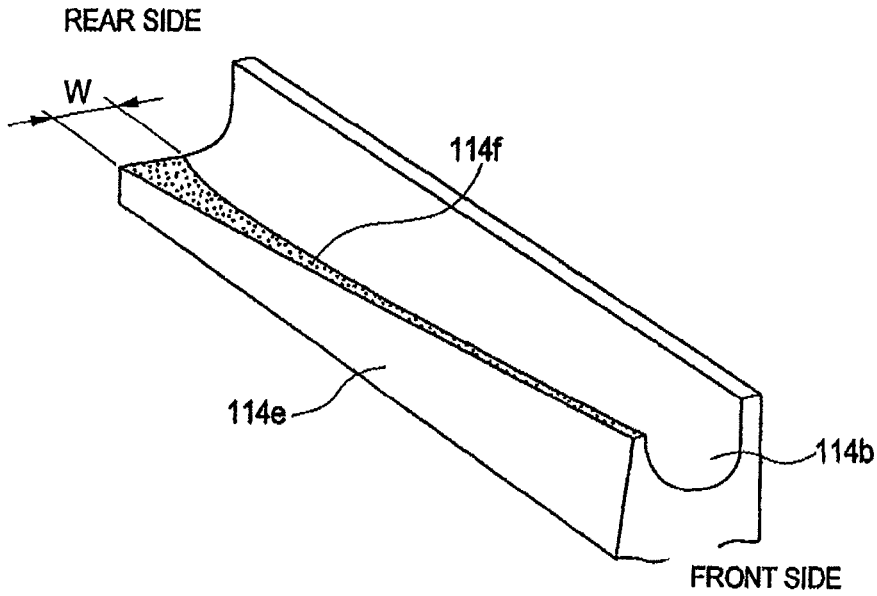
FIG. 6 is an external perspective view illustrating the developer transport path and a developer regulating wall that are included in the developing device illustrated in FIG. 3 and FIG. 4.
Figure 7:
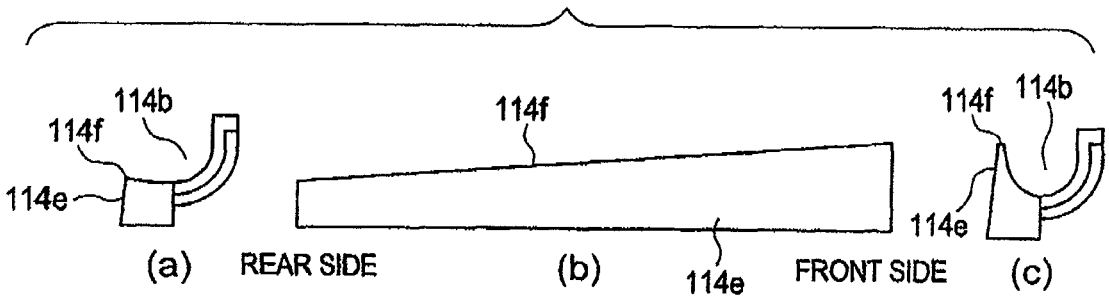
FIG. 7 is a diagram illustrating the developer transport path and the developer regulating wall that is illustrated in FIG. 5, in which (a) is an explanatory side view illustrating an end surface shape of a rear side, (b) is an explanatory front view, and (c) is an explanatory side view illustrating an end surface shape of a front side.

On the other hand, as a countermeasure against a high humidity environment with a bad flowability, a width W of an upper surface of the developer transport path 114*b*, in other words; a surface in a back-and-forth direction orthogonal to the developer transport direction is formed to be enlarged toward the developer transport direction. That is, as illustrated in FIG. 6, the upper rim portion 114*f* of the developer regulating wall 114*e* is formed to become higher on the front side and become lower on the rear side in such manner that the width W of an upper surface of the wall becomes wider as the inclination becomes lower. Therefore, the developer transported by the abovementioned transporting screw 114*d* from the front side toward the rear side in the longitudinal direction falls toward a developer agitating member 114*g* while forming the wall of the developer on an upper surface of the upper rim portion 114*f* of the developer regulating wall 114*e*.

Figure 12:
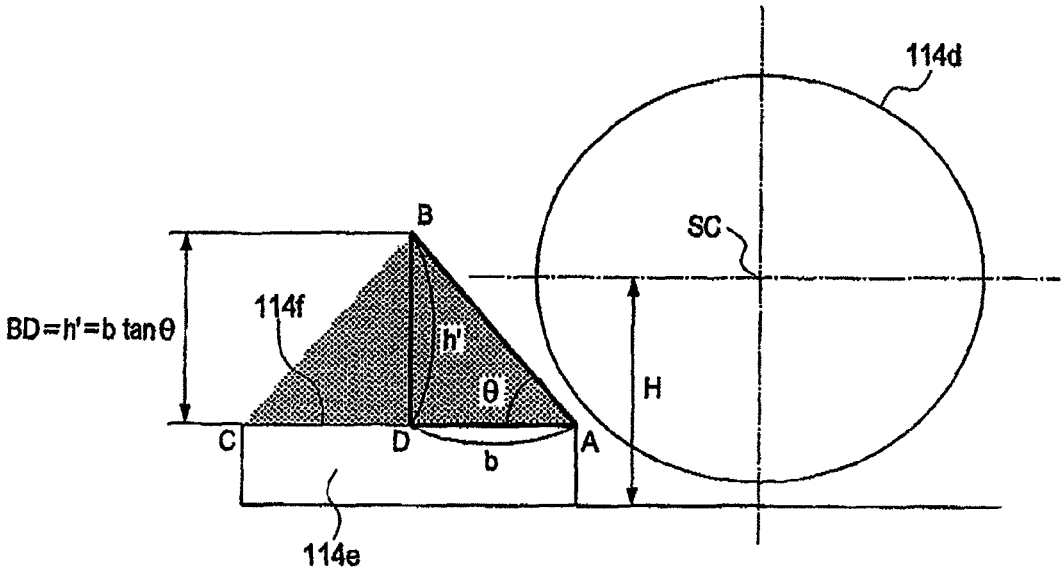
FIG. 12 is a schematic, diagram illustrating a transporting screw, the developer regulating wall, and a stack of developer formed on the upper rim portion thereof.

Here, a characteristic part of the embodiment of the present invention is described in detail with reference to FIG. 12. FIG. 12 is a schematic diagram illustrating the transporting screw, the developer regulating wall, and a stack of developer formed on the upper rim portion thereof. As described above, the developer with which the developing device is replenished has the flowability changing depending on the use environment. Specifically, the flowability tends to become lower under the higher humidity environment, and it is difficult to maintain the flowability at a fixed level corresponding to a humidity change. There is an angle of repose used as an index indicating the flowability. The angle of repose is an index indicating the flowability of powder, and becomes larger as the flowability becomes lower.

If the flowability becomes lower, the developer transported from the supply port in the longitudinal direction while being caused to rotate by the transporting screw exhibits lowered transport property in the longitudinal direction and increased transport property in a rotational direction of the transporting screw. With an increase of the transport property in the rotational direction, the developer regulating wall becomes easier to climb over, and the distribution of the amount of fall of the developer in the longitudinal direction becomes more on the front side in a longitudinal transport direction, which hinders even replenishment of the developer in the longitudinal direction. According to an aspect of the present invention, a vertex B of the developer formed on the developer regulating wall under an environment With a humidity of 50% or higher is forted at an upper level than a rotational center of an adjacent agitating screw. To this end, by defining the width of the upper rim portion of the developer regulating wall, it is possible to obtain a desired height of the stack of the developer.

A method of calculating the height of the vertex of the developer is as follows. That is, when the stack of the developer formed on the width A-C of the upper rim portion of the developer regulating wall is assumed to be A-B-C, a contact point between a orthogonal from the vertex B and a base of a triangle is assumed to be D, a length between A-D is assumed to be b, and the angle BAC is assumed to be the angle of repose θ, a height h' between B-D can be obtained by the following expression.

$$h' = b \tan \theta$$

Further, assuming that a distance between the rotational center SC of the transporting screw and the base of the developer container is set as H, the width A-C of the developer regulating wall is defined in order to realize $H<h'$.

With the above-mentioned structure, even Under the environment with a humidity of 50% or higher, the developer transported from the agitating screw in the rotational direction falls while climbing over the wall formed by the developer, which allows the developer to evenly fall in the longitudinal direction within the developer container. Further, if the environment in which the image forming apparatus is installed is subjected to a change from a high humidity to a low humidity, the wall of the developer formed on the developer regulating wall has the vertex lowered as the angle of repose becomes lower and has the transport property in the longitudinal direction increased by the transporting screw, and hence the developer can be caused to evenly fall even if the transport property in the rotational direction of the transporting screw is lowered. Note that, in this embodiment, the width A-C of the developer regulating wall is set to 1 mm on the front side and 12 mm on the rear side.

Figure 10A:
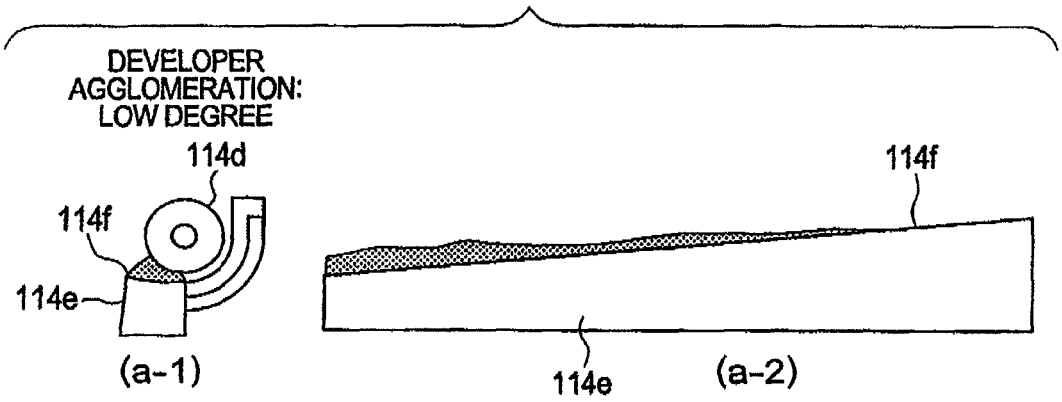
FIG. 10A is a diagram illustrating a wall of a developer formed on an upper surface of the developer regulating wall provided to the developing device according to the embodiment of the present invention, in which (a-1) is a side view of an end surface of the rear side in a case of using the developer having a low agglomeratability and (a-2) is a front view thereof in the case of using the developer having the low agglomeratability.
Figure 10B:
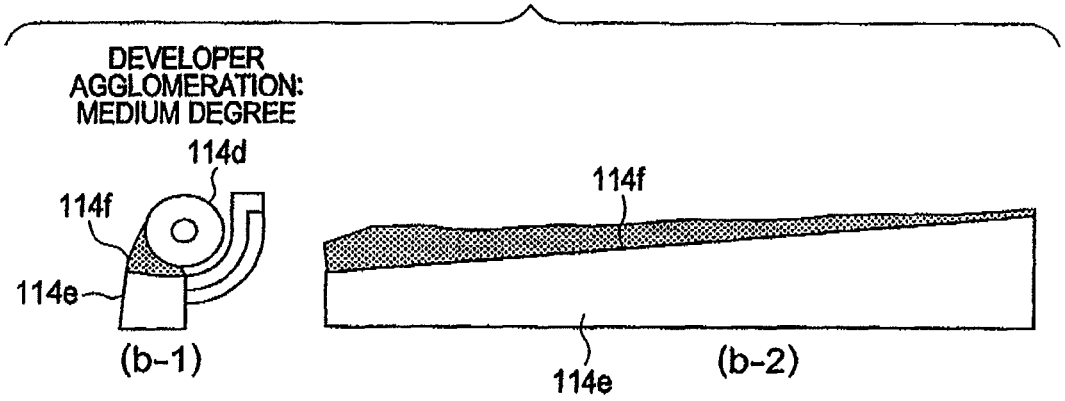
FIG. 10B is a diagram illustrating a wall of a developer formed on the upper surface of the developer regulating wall provided to the developing device according to the embodiment of the present invention, in which (b-1) is a side view of the end surface of the rear side in a case of using the developer having a medium agglomeratability and (b-2) is a front view thereof in the case of using the developer having the medium agglomeratability.
Figure 10C:
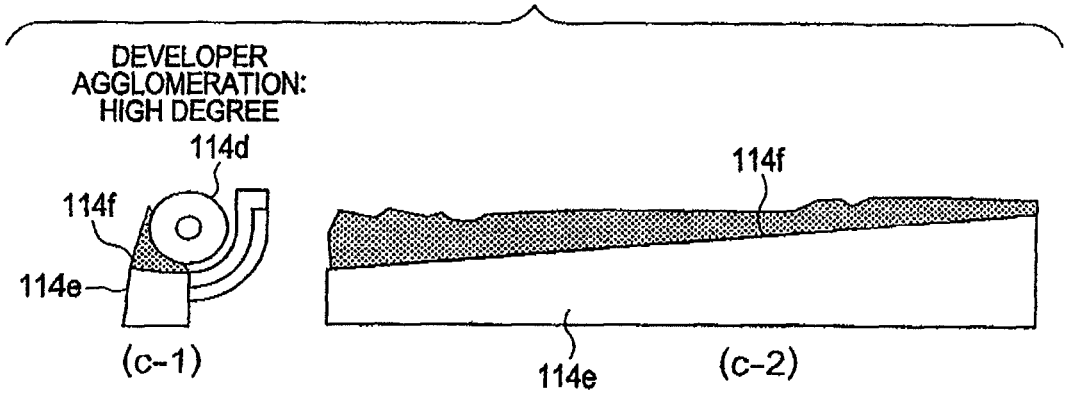
FIG. 10C is a diagram illustrating a wall of a developer formed on the upper surface of the developer regulating wall provided to the developing device according to the embodiment of the present invention, in which, (c-1) is a side view of the end surface of the rear side in a case of using the developer having a high agglomeratability and (c-2) is a front view thereof in the case of using the developer having the high agglomeratability.
Figure 11:
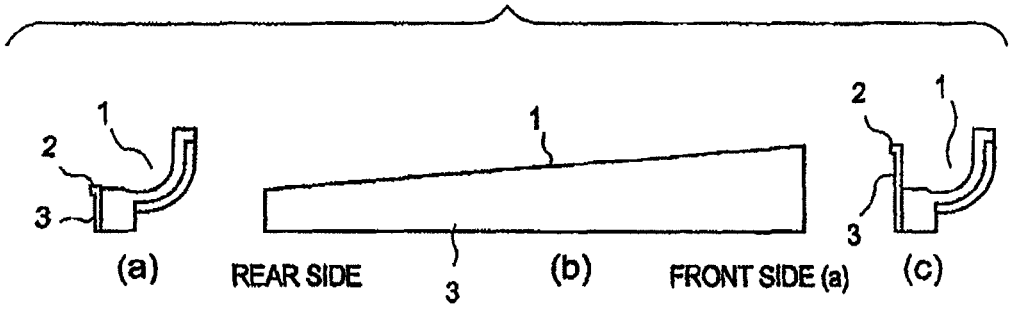
FIG. 11 is a diagram illustrating the developer transport path and the developer regulating wall according to the conventional developing device, in which (a) is an explanatory side view illustrating the end surface shape of the rear side, (b) is an explanatory front view, and (c) is an explanatory side view illustrating the end surface shape of the front side.

According to such a structure as described above, if there is a change in the agglomeratability of the developer due to a change in the use environment of the apparatus, with regard to the wall of the developer formed on the upper rim portion 114*f* of the developer regulating wall 114*e*, the wall of the developer having a low agglomeratability is low as illustrated in FIG. 10A, and the wall of the developer having a high agglomeratability is formed to be high as illustrated in FIG. 10C. Further, as illustrated in FIG. 10B, the wall of the developer having a middle agglomeratability is formed to have a Middle height. The developer transported within the developer transport path 114*b* along the longitudinal direction is transported in the longitudinal direction while climbing over the wall of the developer formed on the Upper rim portion 114*f* of the developer regulating wall 114*e*, and is supplied toward the developer agitating member 114*g* of the developer container while climbing over the wall of the developer or breaking the wall.

Figure 9:
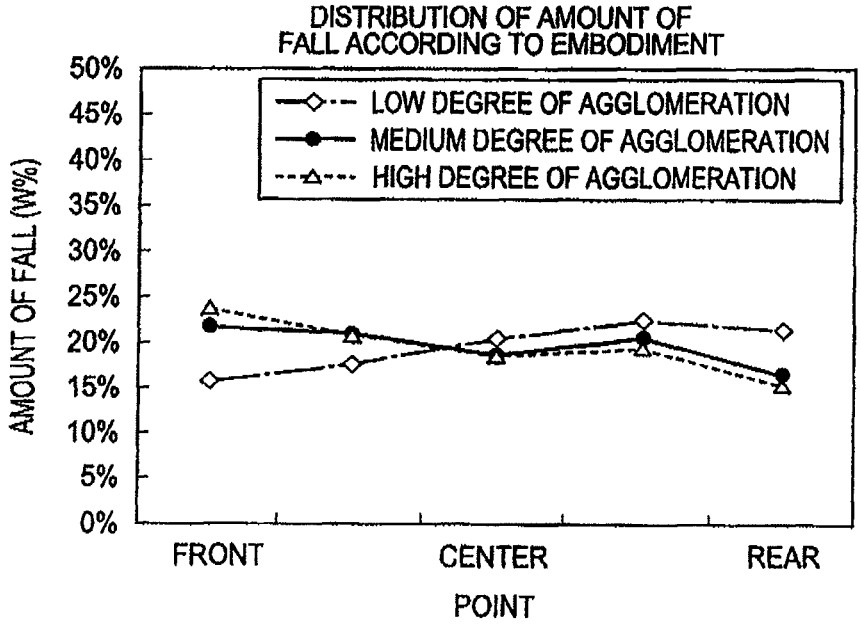
FIG. 9 is a chart Illustrating the distribution of the amount of fall in the longitudinal direction exhibited by the developing device according to the embodiment of the present invention.

By the continuous occurrence Of such a phenomenon, the distribution of the amount of fall of the developer can be maintained even, and a satisfactory image without image degradation can be provided. The results are illustrated in FIG. 9. That is, in comparison with the conventional example illustrated in FIG. 8, the distribution of the amount of fall of the developer in the longitudinal direction is apparently controlled substantially evenly irrespective of the agglomeratability of the developer, which can prevent a difference in density within one page. Therefore, according to this embodiment, even if the number of printing sheets increases, a satisfactory image without image degradation can be obtained irrespective of the agglomeratability of the developer.

The embodiment of the invention made by the present inventors has been described above specifically, but the present invention is not limited to the above-mentioned embodiment, and various changes can naturally be made within the scope that does not depart from the gist of the invention.

For example, the description of the above-mentioned embodiment is directed to a case of being applied to a one-component developing device of a monochrome copying machine, but the present invention is not limited thereto. The present invention can be applied to, for example, a color copying machine and a printer, and can also be applied to the, two-component developing device. Note that, the detected developer amount on the two-component developing device means a ratio of the developer to carrier particles, that is, the density of the developer.

As has been described above, the developing device and the image forming apparatus including the same according to the present invention can be widely applied to diverse apparatuses including the image forming apparatus such as the printer or the copying machine.

While the present invention has been described With reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2009-293604, filed Dec. 25, 2009, and No. 2010-281411, filed Dec. 17, 2010, which are hereby incorporated by reference herein in their entirety.

What is claimed is:

1. A developing device, comprising:

a developer transport path configured to transport a developer along an axial direction of a developer carrying member;

a delveloper transporting unit transporting the developer from one end portion toward another end portion in a developer transport direction of the developer transport path;

an agitating chamber provided between the developer carrying member and the developer transport path, the agitating chamber agitating the transported developer and supplying the developer to the developer carrying member; and a developer regulating wall provided along the developer transport direction of the developer transport path, the developer regulating wall regulating an amount of the developer that falls from the developer transport path to the agitating chamber, wherein:

an upper rim portion of the developer regulating wall is formed so that the transported developer falls to the agitating chamber and the upper rim portion inclines so as to become lower in height from an upstream side toward a downstream side in the developer transport direction, and the upper rim portion of the developer regulating wall is formed so that a width thereof in a direction orthogonal to the developer transport direction is enlarged as a height of the upper rim portion becomes lower.

2. A developing device according to claim 1, wherein the developer transport path comprises a developer supply port provided in proximity to a position in which the upper rim portion of the developer regulating wall has a maximum height, and the developer is supplied to the developer transport path via the developer supply port.

3. A developing device according to claim 1, wherein the developer transporting unit is a helical-shaped screw member.

4. A developing device according to claim 2, further comprising a developer supplying unit supplying the developer to the developer transport path via the developer supply port, wherein the developer is supplied from the developer supply port intermittently.

5. An image forming apparatus, comprising the developing device according to claim 1.

* * * * *